US005537988A

United States Patent [19]

Lin

[11] Patent Number: 5,537,988

[45] Date of Patent: Jul. 23, 1996

[54] GREASE GUIDING TRAY FOR A KITCHEN VENTILATOR

[75] Inventor: Yi-Han Lin, Feng-Yuan, Taiwan

[73] Assignee: Sung-Lin Huang, Taichung Hsien, Taiwan

[21] Appl. No.: 517,423

[22] Filed: Aug. 21, 1995

[51] Int. Cl.[6] ..... F24C 15/20

[52] U.S. Cl. ..... 126/299 D; 126/299 R

[58] Field of Search ..... 126/299 R, 299 D; 454/341, 349, 354

[56] References Cited

U.S. PATENT DOCUMENTS

| | | | |
|---|---|---|---|
| 1,569,845 | 1/1926 | Murphy | 454/341 X |
| 5,228,428 | 7/1993 | Jang | 126/299 D |
| 5,372,122 | 12/1994 | Hong et al. | 126/299 D |

*Primary Examiner*—Harold Joyce
*Attorney, Agent, or Firm*—Brumbaugh, Graves, Donohue & Raymond

[57] ABSTRACT

A grease guiding tray for a kitchen ventilator includes a tray unit and an annular fence member. The tray unit includes an annular plate with inner and outer peripheral edges, an inner ring which projects upwardly from the inner peripheral edge and which has a top end formed with an annular flange that extends radially inward and then upward, an outer ring which projects upwardly from the outer peripheral edge and which cooperates with the inner ring so as to confine an annular recess therebetween, and an annular partition which projects upwardly from the annular plate and which extends into the annular recess between the inner and outer rings. The partition is formed with at least one notch, while the outer ring is formed with a radial opening. The fence member includes an annular surrounding wall that diverges gradually from a bottom end thereof, and an annular base plate that is connected to and that inclines upwardly from the bottom end of the surrounding wall. The base plate is formed with a grease hole and is secured to the annular flange on the inner ring of the tray unit.

5 Claims, 4 Drawing Sheets

GREASE GUIDING TRAY FOR A KITCHEN VENTILATOR

BACKGROUND OF THE INVENTION

1. Field of the Invention

The invention relates to a grease guiding tray for a kitchen ventilator, more particularly to a grease guiding tray which can prevent the spilling of grease that has accumulated thereon when the kitchen ventilator is in use.

2. Description of the Related Art

In a conventional kitchen ventilator, a grease guiding tray is installed at the periphery of an inlet port of a ventilator housing, the inlet port being located below an exhaust fan of the kitchen ventilator. Grease or oil droplets from fumes drawn by the exhaust fan accumulate on the grease guiding tray and are guided by the same to a collecting unit, such as a grease cup. Usually, the grease guiding tray is spaced from the exhaust fan at an appropriate distance. Thus, when the exhaust fan is operated, all of the fumes drawn by the exhaust fan cannot be instantly delivered to the exhaust duct, thereby resulting in air currents between the grease guiding tray and the exhaust fan which can result in the spilling of the grease that has accumulated on the grease guiding tray.

FIG. 1 illustrates a conventional grease guiding tray 1 which is installed in a kitchen ventilator. The kitchen ventilator includes a ventilator housing 3 which has a bottom side that is formed with an inlet port 3*a*, an exhaust duct 3*b* which is mounted in the ventilator housing 3 and which has a bottom side formed with an opening 3*c* that is aligned with the inlet port 3*a*, and an exhaust fan 2 which is mounted in the exhaust duct 3*b*. The exhaust fan 2 includes a fan motor 2*b* with a drive shaft 2*c*, and a fan blade unit. The fan blade unit includes a bowl-shaped top plate 2*d* that is connected to the drive shaft 2*c*, an annular wall member 2*a* that is disposed below the top plate 2*d* and that diverges gradually from a bottom end thereof, and a plurality of fan blades 2*e* disposed between the top plate 2*d* and the wall member 2*a*. Each of the fan blades 2*e* has a top edge connected to the top plate 2*d* and a bottom edge connected to the wall member 2*a*.

The grease guiding tray 1 can minimize the risk of spilling of grease that has accumulated thereon when the kitchen ventilator is in use. The grease guiding tray 1 includes an annular tray body with concentric inner and outer rings 1*a*, 1*b* that project upwardly therefrom. The inner and outer rings 1*a*, 1*b* confine an annular grease collecting path 1*c* therebetween. An annular fence 1*d* is disposed in the grease collecting path 1*c* and serves to prevent the spilling of grease in the grease collecting path 1*c*. The grease guiding tray 1 is to be seated on an inner side of the inlet port 3*a* of the ventilator housing 3 such that the outer ring 1*b* is disposed around the opening 3*c* of the exhaust duct 3*b*, and such that the inner ring 1*a*and the annular fence 1*d* are disposed spacedly and respectively on inner and outer sides of the wall member 2*a* of the fan blade unit.

The drawbacks of the conventional grease guiding tray 1 are as follows:

1. The grease guiding tray 1 is incapable of fully preventing the spilling of grease that has accumulated thereon when the kitchen ventilator is in use. When the exhaust fan 2 is operated, the air currents that are generated (as shown by the arrows) can force the grease in the grease collecting path 1*c* to overflow. Particularly, air current which passes through a hole 1*e* in the annular fence 1*d* can force grease in an inner portion 1*c*′ of the grease collecting path 1*c* between the annular fence 1*d* and the inner ring 1*a*to move past the inner ring 1*a*and spill from the grease guiding tray 1. Air current which passes through a clearance formed between the annular fence 1*d* and the wall member 2*a* can also force grease in the inner portion 1*c*′ of the grease collecting path 1*c* to move past the inner ring 1*a*and spill from the grease guiding tray 1.

2. The presence of the annular fence 1*d* causes some inconvenience in the installation of the conventional grease guiding tray 1. When installing the grease guiding tray 1, the clearance between the annular fence 1*d* and the wall member 2*a* should be kept as small as possible to minimize the risk of spilling of grease in the grease collecting path 1*c*. However, in, actual practice, this clearance should be made as wide as possible to facilitate installation of the grease guiding tray 1 and to allow for a margin of error during installation to prevent the fan blade unit of the exhaust fan 2 from striking the annular fence 1*d* when the exhaust fan 2 is in use.

SUMMARY OF THE INVENTION

Therefore, the object of the present invention is to provide a grease guiding tray for a kitchen ventilator which is capable of overcoming the aforementioned drawbacks that are associated with the prior art.

More specifically, the object of the present invention is to provide a grease guiding tray which is easy to install and which can fully prevent the spilling of grease that has accumulated thereon when installed in a kitchen ventilator.

Accordingly, the grease guiding tray of the present invention is to be used in a kitchen ventilator which includes a ventilator housing that has a bottom side formed with an inlet port, an exhaust duct that is mounted in the ventilator housing and that has a bottom side formed with an opening aligned with the inlet port, and an exhaust fan that is mounted in the exhaust duct. The exhaust fan includes a fan motor and a fan blade unit driven rotatably by the fan motor. The fan motor has a drive shaft. The fan blade unit includes a bowl-shaped top plate that is connected to the drive shaft, an annular wall member that is disposed below the top plate and that diverges gradually from a bottom end thereof, and a plurality of fan blades disposed between the top plate and the wall member. Each of the fan blades has a top edge connected to the top plate and a bottom edge connected to the wall member.

The grease guiding tray comprises a tray unit and an annular fence member. The tray unit includes an annular plate with inner and outer peripheral edges, an inner ring which projects upwardly from the inner peripheral edge and which has a top end formed with an annular flange that extends radially inward and then upward, an outer ring which projects upwardly from the outer peripheral edge and which cooperates with the inner ring so as to confine an annular recess therebetween, and an annular partition which projects upwardly from the annular plate and which extends into the annular recess between the inner and outer rings. The partition is formed with at least one notch, while the outer ring is formed with a radial opening.

The annular fence member includes an annular surrounding wall that diverges gradually from a bottom end thereof, and an annular base plate that is connected to and that inclines upwardly from the bottom end of the surrounding wall. The base plate is formed with a grease hole and is secured to the annular flange on the inner ring of the tray unit.

The tray unit is adapted to be seated on an inner side of the inlet port of the ventilator housing such that the outer ring is disposed around the opening in the exhaust duct, and such that the annular flange on the inner ring and the surrounding wall of the fence member are disposed spacedly and respectively on inner and outer sides of the annular wall member of the fan blade unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
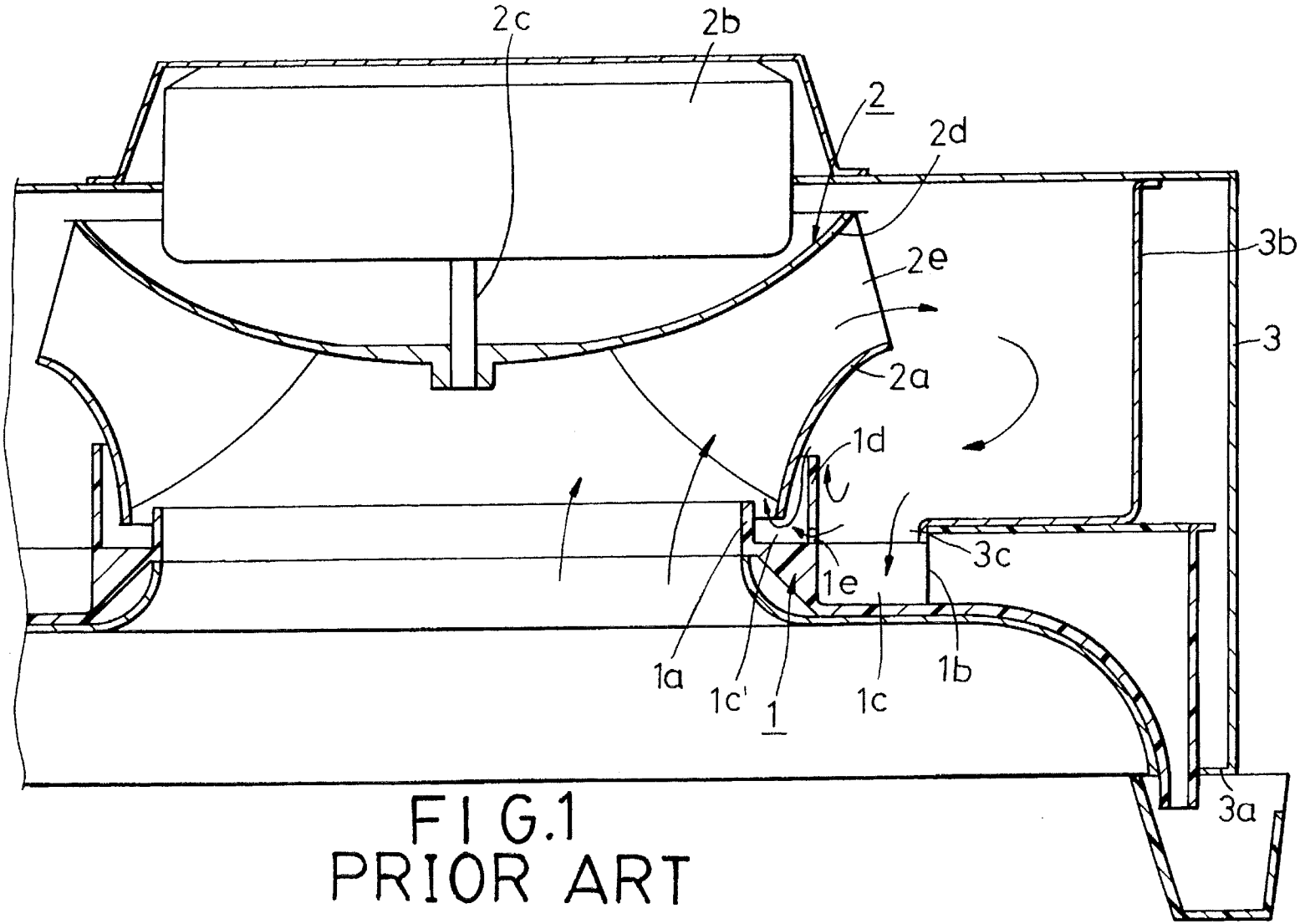
FIG.1 PRIOR ART
FIG. 1 is a sectional view of a kitchen ventilator which employs a conventional grease guiding tray.
Figure 2:
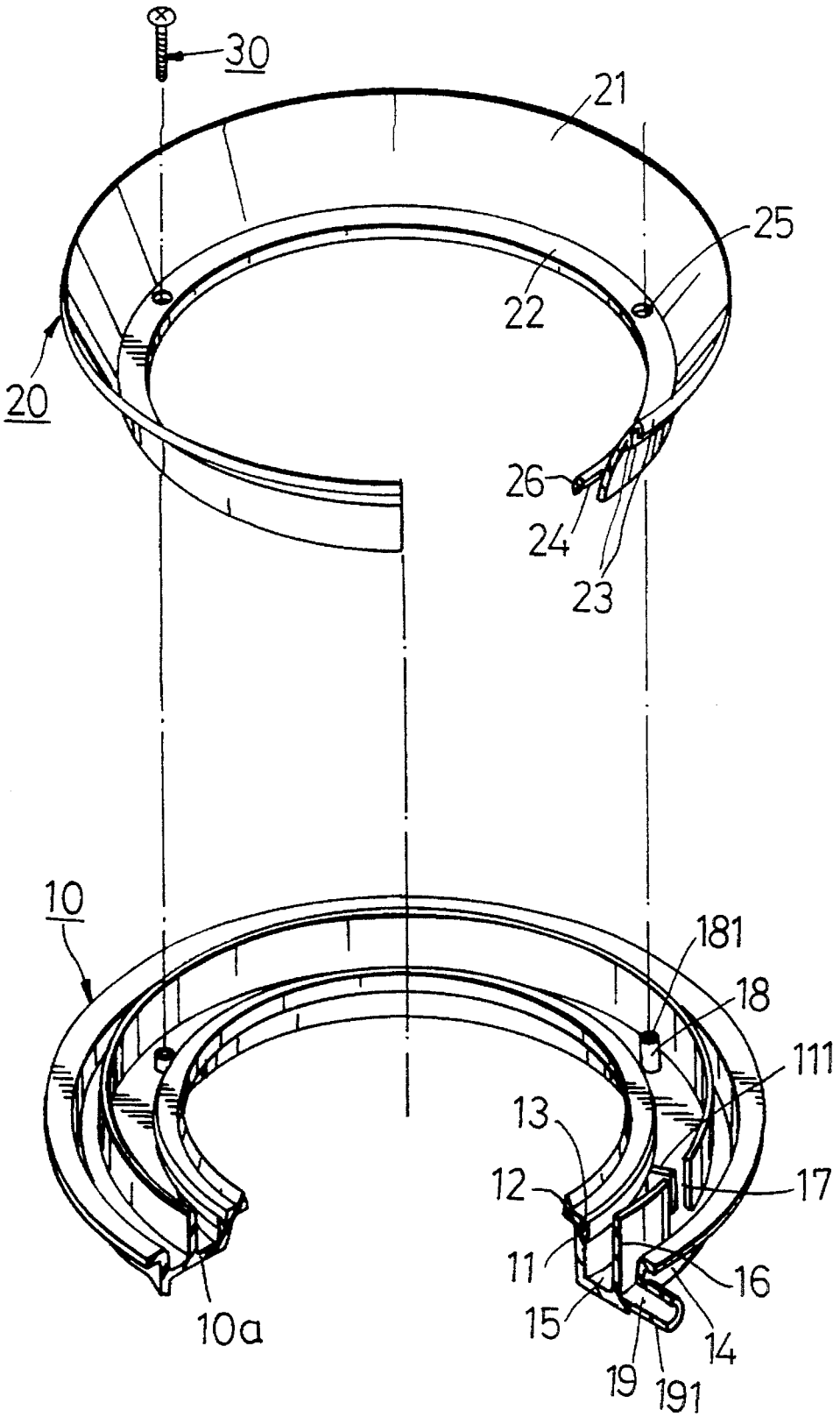
FIG. 2 is an exploded view of the preferred embodiment of a grease guiding tray according to the present invention.

Referring to FIG. 2, the preferred embodiment of a grease guiding tray for a kitchen ventilator in accordance with the present invention is shown to comprise a tray unit 10 and an annular fence member 20.

Figure 3:
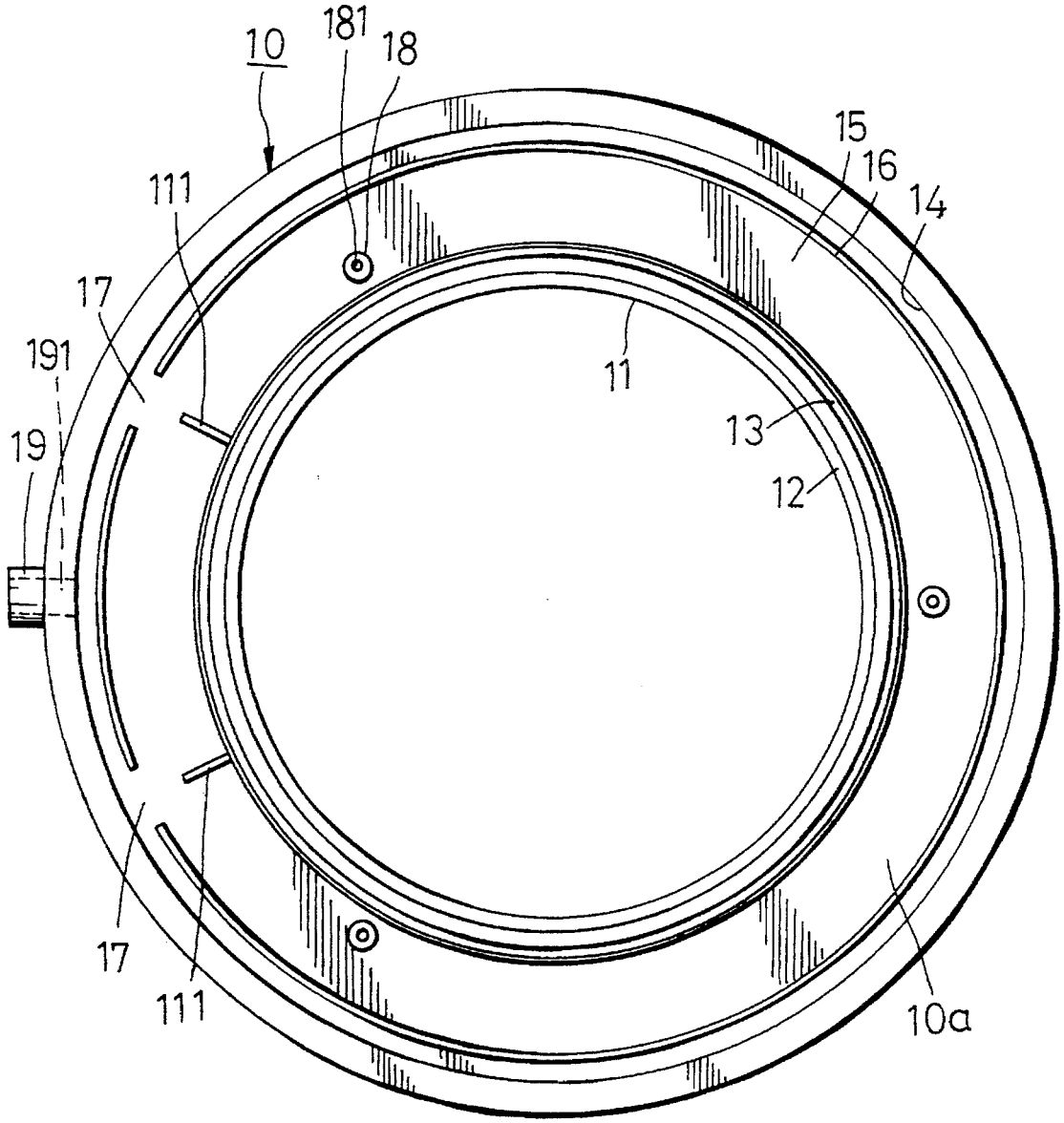
FIG. 3 is a schematic top view of an annular tray unit of the preferred embodiment.

Referring to FIGS. 2 and 3, the tray unit 10 includes an annular plate 10*a* with an inner ring 11 that projects upwardly from an inner peripheral edge thereof. The inner ring 11 has a top end which is formed with an annular flange 12 that extends radially inward and then upwardly. The annular flange 12 has an inner peripheral edge portion that is formed with an annular V-shaped fastening groove 13. The annular plate 10*a* further has an outer ring 14 that projects upwardly from an outer peripheral edge thereof. The inner and outer rings 11, 14 confine an annular recess 15 therebetween. An annular partition 16 projects upwardly from the annular plate 10*a* and extends into the annular recess 15 between the inner and outer rings 11, 14. The partition 16 is formed with two angularly displaced notches 17. The inner ring 11 is further formed with a pair of radial projections 111 that extend radially outward toward the outer ring 14 and that are aligned respectively with the notches 17. Three mounting posts 18 project upwardly from the annular plate 10*a* and are disposed between the annular partition 16 and the inner ring 11. Each of the mounting posts 18 is formed with an axial threaded hole 18. The outer ring 14 is formed with a radial opening 19 that is located between the notches 17. A guide tube 191 extends radially and outwardly from the radial opening 19 of the outer ring 14 to guide outward flow of grease from the annular recess 15.

The annular fence member 20 includes an annular base plate 22 and an annular surrounding wall 21 that is connected to and diverges gradually from a bottom end of the base plate 22. The base plate 22 extends inwardly and inclines upwardly from the bottom end of the surrounding wall 21. The surrounding wall 21 has a top portion with an outer wall surface that is formed with two concentric downwardly extending annular projections 23. The base plate 22 is formed with a grease hole 24 that is staggered with respect to the notches 17, and three mounting holes 25 which permit the passage of three screws 30 for mounting the base plate 22 on the mounting posts 18 of the tray unit 10. The base plate 22 is further formed with an annular V-shaped fastening projection 26 that projects downwardly for engagement with the fastening groove 13 to secure the base plate 22 on the annular flange 12.

Figure 4:
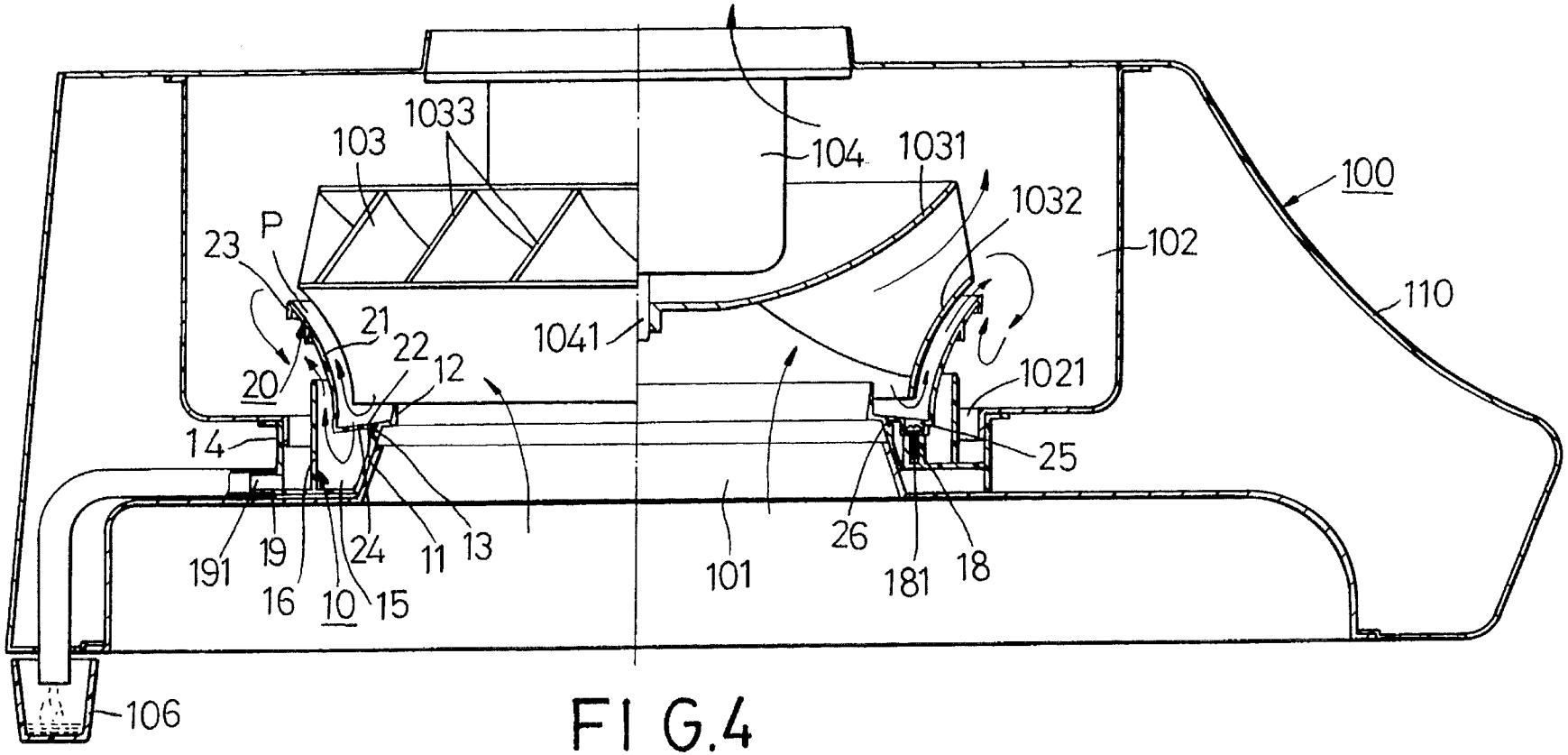
FIG. 4 is a sectional view of a kitchen ventilator which employs the preferred embodiment.

FIG. 4 illustrates the preferred embodiment when installed in a kitchen ventilator which includes a ventilator housing 110 that has a bottom side formed with an inlet port 101, an exhaust duct 102 that is mounted in the ventilator housing 110 and that has a bottom side formed with an opening 1021 aligned with the inlet port 101, and an exhaust fan 103 that is mounted in the exhaust duct 102. The exhaust fan 103 includes a fan motor 104 with a drive shaft 1041, and a fan blade unit. The fan blade unit includes a bowl-shaped top plate 1031 that is connected to the drive shaft 1041, an annular wall member 1032 that is disposed below the top plate 1031 and that diverges gradually from a bottom end thereof, and a plurality of curved fan blades 1033 disposed between the top plate 1031 and the wall member 1032. Each of the fan blades 1033 has a top edge connected to the top plate 1031 and a bottom edge connected to the wall member 1032.

As shown in FIG. 4, the tray unit 10 is seated on an inner side of the inlet port 101 of the ventilator housing 110 such that the outer ring 14 is disposed around the opening 1021 in the exhaust duct 102, and such that the annular flange 12 on the inner ring 11 and the surrounding wall 21 of the fence member 20 are disposed spacedly and respectively on inner and outer sides of the annular wall member 1032 of the fan blade unit. Preferably, the surrounding wall 21 forms a clearance (P) of about 3–8 mm with the annular wall member 1032.

When the fan motor 104 is activated, the fan blade unit of the exhaust fan 103 rotates to draw fumes into the exhaust duct 102. Grease or oil droplets that accumulate on the base plate 22 fall into the annular recess 15 via the grease hole 24. Grease in the annular recess 15 then flows out of the tray unit 10 via the guide tube 191 that extends from the outer ring 14 so as to be collected in a grease cup 106. The air currents that are generated in the exhaust duct 102 are prevented by the fence member 20 from forcing the grease in the annular recess 15 to overflow. As shown by the arrows in FIG. 4, the air currents in the exhaust duct 102 are prevented by the annular partition 16 from reaching the innermost portion of the annular recess 15. In addition, the annular projections 23 on the surrounding wall 21 prevent the air currents in the exhaust duct 102 from entering into a clearance formed between the surrounding wall 21 and the annular partition 16. Since the present invention is designed to effectively prevent the spilling of grease therefrom, the clearance (P) can be made larger to facilitate installation of the grease guiding tray.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A grease guiding tray for a kitchen ventilator, the kitchen ventilator including a ventilator housing which has a bottom side formed with an inlet port, an exhaust duct which is mounted in the ventilator housing and which has a bottom side formed with an opening that is aligned with the inlet port, and an exhaust fan which is mounted in the exhaust duct, the exhaust fan including a fan motor and a fan blade unit driven rotatably by the fan motor, the fan motor having a drive shaft, the fan blade unit including a bowl-shaped top plate that is connected to the drive shaft, an annular wall member that is disposed below the top plate and that diverges gradually from a bottom end of the wall member, and a plurality of fan blades disposed between the top plate and the wall member, each of the fan blades having a top edge connected to the top plate and a bottom edge connected to the wall member, said grease guiding tray comprising:

a tray unit including an annular plate with inner and outer peripheral edges, an inner ring which projects upwardly from said inner peripheral edge and which has a top end formed with an annular flange that extends radially inward and then upward, an outer ring which projects upwardly from said outer peripheral edge and which cooperates with said inner ring so as to confine an annular recess therebetween, and an annular partition which projects upwardly from said annular plate and which extends into said annular recess between said inner and outer rings, said partition being formed with at least one notch, said outer ring being formed with a radial opening; and an annular fence member including an annular base plate and an annular surrounding wall that is connected to and diverges gradually from a bottom end of the base plate, said base plate extending inwardly and inclining upwardly from said bottom end of said surrounding wall, said base plate being formed with a grease hole and being secured to said annular flange on said inner ring of said tray unit;

said tray unit being adapted to be seated on an inner side of the inlet port of the ventilator housing such that said outer ring is disposed around the opening in the exhaust duct, and such that said annular flange on said inner ring and said surrounding wall of said fence member are disposed spacedly and respectively on inner and outer sides of the annular wall member of the fan blade unit.

2. The grease guiding tray as claimed in claim 1, wherein said annular flange on said inner ring of said tray unit has an inner peripheral edge portion that is formed with an annular fastening groove, said base plate of said fence member being formed with an annular fastening projection which engages said fastening groove to secure said base plate on said annular flange.

3. The grease guiding tray as claimed in claim 1, wherein said annular plate of said tray unit has a plurality of mounting posts that project upwardly therefrom and that are disposed between said annular partition and said inner ring, said base plate of said fence member being supported on said mounting posts and being mounted thereon by means of screws.

4. The grease guiding tray as claimed in claim 1, wherein said surrounding wall of said fence member has a top portion with an outer wall surface that is formed with at least one downwardly extending annular projection.

5. The grease guiding tray as claimed in claim 1, wherein said radial opening in said outer ring of said tray unit is staggered with said notch in said partition.

* * * * *